US010615505B2

(12) United States Patent
Owens

(10) Patent No.: US 10,615,505 B2
(45) **Date of Patent: *Apr. 7, 2020**

(54) SLOT HALO ANTENNA DEVICE

(71) Applicant: Skywave Antennas, Inc., Huntsville, AL (US)

(72) Inventor: Roger Owens, Huntsville, AL (US)

(73) Assignee: Skywave Antennas, Inc., Huntsville, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/681,946

(22) Filed: Aug. 21, 2017

(65) Prior Publication Data

US 2017/0346187 A1 Nov. 30, 2017

Related U.S. Application Data

(63) Continuation of application No. 14/603,573, filed on Jan. 23, 2015, now Pat. No. 9,742,071, which is a continuation of application No. 14/034,473, filed on Sep. 23, 2013, now Pat. No. 8,941,542, which is a continuation of application No. 12/619,506, filed on Nov. 16, 2009, now Pat. No. 8,542,153.

(51) Int. Cl.
*H01Q 13/10* (2006.01)
*H01Q 1/22* (2006.01)

(52) U.S. Cl.
CPC ..... *H01Q 13/106* (2013.01); *H01Q 1/2233* (2013.01); *H01Q 13/10* (2013.01)

(58) Field of Classification Search
CPC ..... H01Q 1/2233; H01Q 13/10; H01Q 13/106
See application file for complete search history.

(56) References Cited

U.S. PATENT DOCUMENTS

| | | | | |
|---|---|---|---|---|
| 5,539,420 A * | 7/1996 | Dusseux | ..... | H01Q 9/0414 343/700 MS |
| 8,542,153 B2 * | 9/2013 | Owens | ..... | H01Q 1/2233 343/702 |
| 8,941,542 B2 * | 1/2015 | Owens | ..... | H01Q 1/2233 343/702 |
| 9,742,071 B2 * | 8/2017 | Owens | ..... | H01Q 1/2233 |

* cited by examiner

*Primary Examiner* — Robert Karacsony
(74) *Attorney, Agent, or Firm* — Angela Holt; Bradley Arant Boult Cummings LLP

(57) ABSTRACT

An antenna of the present disclosure has a radiating element having an arc-shaped slot. A parasitic element is spaced apart from the radiant element, and is not electrically connected to the radiating element. An insulating material is disposed between the radiating element and the parasitic element.

10 Claims, 11 Drawing Sheets

SLOT HALO ANTENNA DEVICE

CROSS-REFERENCE TO RELATED APPLICATIONS

This application is a continuation of and claims the benefit of U.S. Non-Provisional application Ser. No. 14/603,573, titled "Slot Halo Antenna Device," filed on Jan. 23, 2015, which is a continuation of U.S. Non-Provisional application Ser. No. 14/034,473 titled "Slot Halo Antenna Device," filed on Sep. 23, 2013, which is a continuation of U.S. Non-Provisional application Ser. No. 12/619,506 titled "Slot Halo Antenna Device," filed on Nov. 16, 2009. The entire contents of all three applications are incorporated herein by reference.

FIELD OF THE INVENTION

The present disclosure generally relates to the field of antennas. More particularly, the present disclosure relates to antennas having a low-profile installation that radiate radio-frequency (RF) energy having dual polarization.

BACKGROUND

An antenna is a device that transmits and/or receives electromagnetic waves. In this regard, the antenna converts electromagnetic waves into an electrical current and converts electrical current into electromagnetic waves. Typically, the antenna is an arrangement of one or more conductors, which are oftentimes referred to as elements. To transmit a signal, a voltage is applied to terminals of the antenna, which induces an alternating current (AC) in the elements of the antenna, and the elements radiate an electromagnetic wave indicative of the induced AC. To receive a signal, an electromagnetic wave from a source induces an AC in the elements, which can be measured at the terminals of the antenna.

The design of the antennas typically dictates the direction in which the antenna transmits signals in a particular direction. Notably, an antenna may transmit signals horizontally (parallel to the ground) or vertically. One common antenna is a vertical rod. A vertical rod antenna receives and transmits in a vertical direction. One limitation of the vertical rod antenna is that it does not transmit or receive in the direction in which the rod points, i.e., it does not transmit or receive vertically.

There are two types of antenna directional patterns: omni-directional and directional. An omni-directional antenna radiates equally in all directions. An example of an omni-directional antenna is the vertical rod antenna. A directional antenna radiates in one direction more than another.

Antennas are oftentimes used in radio telemetry systems for system control and data acquisition (SCADA) applications, where a vertical rod antenna may not be desirable. In this regard, antennas may be used in traffic control security, irrigation systems, gas, electric, water and power line communications. In such exemplary systems, the antenna may be mounted in a location that would not be appropriate for normal length vertical rod antennas. Indeed an antenna used in such systems may need to be mounted in a position such that the vertical rod antenna would physically interfere with other equipment being used in the system.

SUMMARY

An antenna of the present disclosure has a housing having a shallow cavity in a top of the housing and a shallow cavity in a bottom of the housing. The antenna further has a substantially circular radiating element disposed in the shallow cavity on the top of the housing, the radiating element having an arc shape slot. In addition, the antenna has a substantially circular parasitic element disposed in the shallow cavity on the bottom of the housing.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the invention. Furthermore, like reference numerals designate corresponding parts throughout the several views.

DETAILED DESCRIPTION

The present disclosure generally pertains to a low-profile horizontally mounted antenna for mounting to plastics, metals and concrete without causing the antenna to detune or requiring the retuning of the antenna. In particular, the low-profile antenna of the present disclosure is a half-wave omni-directional antenna that uniformly radiates a vertically and horizontally polarized antenna signal.

Figure 1B:
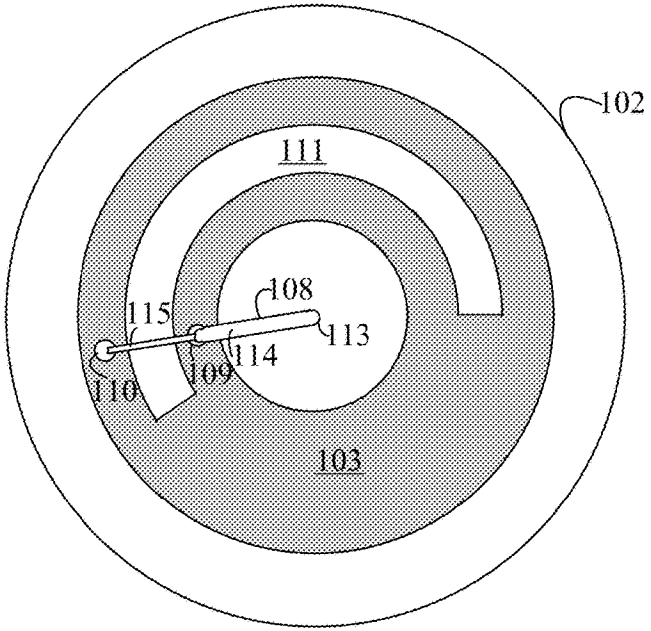
FIG. 1B is a top plan view of the antenna of FIG. 1A.
Figure 1A:
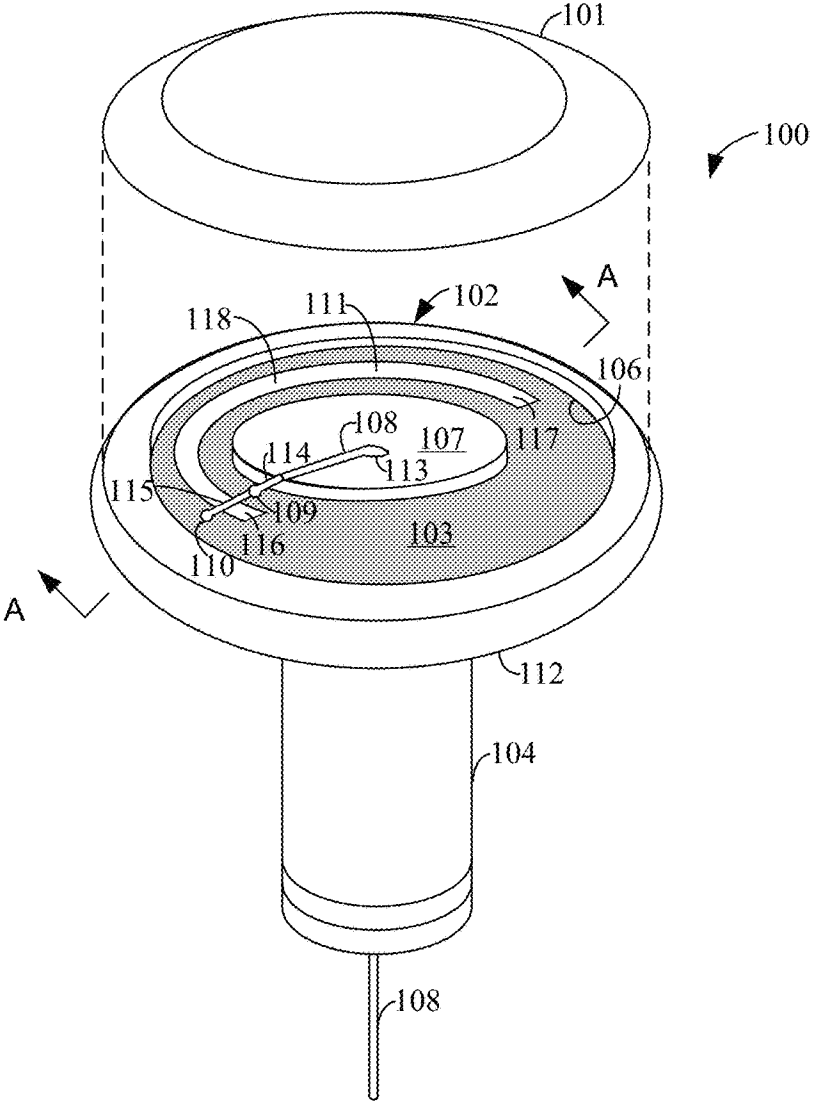
FIG. 1A depicts an exploded view of an antenna in accordance with an embodiment of the present disclosure.

FIG. 1A is an exploded view of an antenna 100 in accordance with an embodiment of the present disclosure. The antenna 100 comprises a substantially circular housing 102 and a top cover 101. In one embodiment, the circular housing 102 and the top cover 101 are made of an insulating material, such as, for example polypropylene.

During operation, the top cover 101 is affixed to the substantially circular housing 102. As will be described further herein, the antenna 100 emits electromagnetic waves (not shown) that are both horizontally and vertically polarized. Such electromagnetic waves are emitted through the top cover 101 when it is affixed to the circular housing 102.

The housing 102 comprises a shallow cavity 106 and a substantially circular protrusion 107 that extends from the cavity 106. The circular protrusion 107 is also made of an insulating material, such as, for example polypropylene. Notably, in one embodiment, the shallow cavity 106 is integrally formed with the circular protrusion 107.

Fixed within the cavity 106 is a radiating element 103. The radiating element 103 is substantially circular and is made of a conductive material, such as, for example copper. In one embodiment, the radiating element 103 is made from a stamped piece of metal copper alloy having a thickness of 2 mils.

Furthermore, the radiating element 103 comprises a slot 111 formed within the radiating element 103. The slot 111 is formed in an arc shape. Notably, the slot 111 is formed by the absence of the conductive material that makes up the radiating element 103. In one embodiment, the slot 111 exhibits a uniform width.

The impedance of the slot 111 is distributed along the slot 111 in such a way that at the ends 116 and 117 of the slot 111 the impedance is the lowest, i.e., at the very ends it is zero. As the slot 111 continues from the ends 116 and 117 to the middle 118 of the slot 111, the impedance increases, i.e., the impedance reaches an amount from 300 to 500 ohms (Ω).

The antenna 100 further comprises a tube 104. The tube 104 is substantially circular and hollow. The tube 104 is affixed to the underside of the housing 102. The tube may be made of any type of plastic material known in the art or future-developed. The tube 104 as depicted in FIG. 1A is affixed to a center of the housing 102. The tube 104 allows the antenna 100 to be affixed to a structure (not shown), and the tube 104 fits within an opening (not shown) in the structure.

A coaxial cable 108 is fed up through the tube 104 and through an opening 113 in the circular protrusion 107. The coaxial cable 108 comprises a shield 114 and a wire 115. The shield 114 is electrically connected at point 109 to the radiating element 103 on one side of the slot 111. In addition, the wire 115 is electrically connected at point 110 on the opposite side of the slot 111 from the point 109. The wire 115 is unshielded from the connection point 109 to the connection point 110. In one embodiment, the shield 114 and the wire 115 are electrically connected to points 109 and 110, respectively, by soldering the shield 114 and the wire 115 to the radiating element 103.

As described hereinabove, the slot 111 exhibits its lowest impedance at its ends 116 and 117, and the impedance of the slot 111 increases from the ends 116 and 117 to a center point 118 of the slot 111. Furthermore, the coaxial cable 108 exhibits an impedance that is in the range of 50 to 75Ω. Thus, the shield 114 and the wire 115 are connected to the radiating element 103 at points 109 and 110, which is that portion of the slot 111 that exhibits impedance at 50 to 75Ω.

During operation, a radio frequency (RF) signal is supplied from a signal source (not shown) to the coaxial cable 108. The RF signal is applied at points 109 and 110 on the radiating element 103. The RF signal applied produces an alternating current (AC) in the radiating element 103, which produces an electromagnetic wave (not shown) emanating from the slot 111. The electromagnetic waves emanating from the slot 111 are both vertically and horizontally polarized. In this regard, the vertically polarized electromagnetic waves emanate from the slot, and the horizontally polarized electromagnetic waves emanate from the arced portions of the slot 111. The electromagnetic waves are radiated uniformly from the radiating element 103.

Note that an underside 112 of the housing 102 is substantially flat. This allows the antenna 100 to be mounted to a structure (not shown) with the tube 104 passing through the structure. For example, the antenna 100 may be mounted to a water meter (not shown). In this regard, the antenna 100 is a low profile antenna that allows easy installation where a conventional antenna, for example a rod antenna, would be difficult to use.

Figure 2:
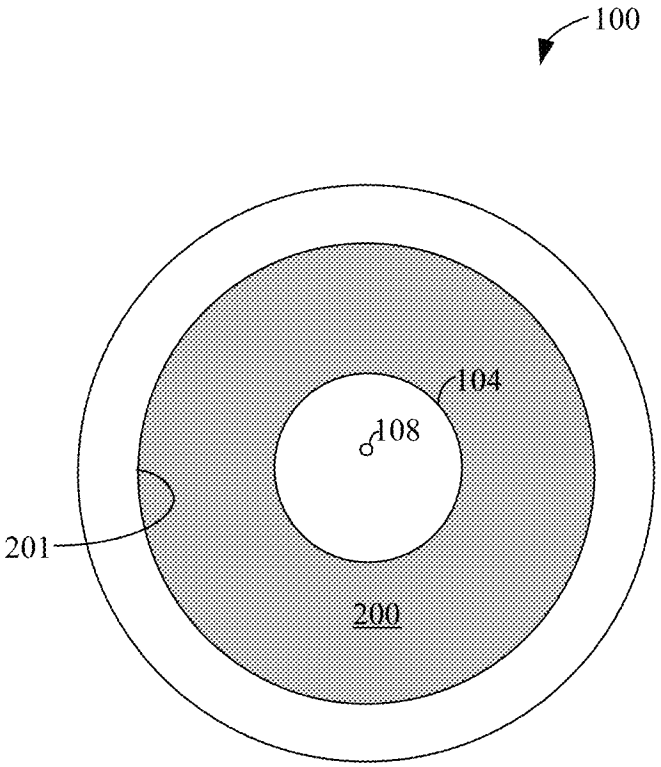
FIG. 2 depicts a bottom view of the antenna of FIG. 1A.

FIG. 2 depicts a bottom view of the housing 102 of FIG. 1A. Formed within the housing 102 is a cavity 201. Within the cavity 201 is a substantially circular parasitic element 200. The parasitic element 200 can be made of any type of conductive material, such as, for example copper. The parasitic element 200 does not connect to the coaxial cable 108 or the radiating element 103 (FIG. 1A).

Furthermore, the tube 104 is located in the center of the parasitic element, and the coaxial cable 108 runs up through the tube 104. In one embodiment, the diameter of the parasitic element is 76.2 mm. In addition, the diameter of the tube 104 is 43.561 mm.

The parasitic element 200 isolates the radiating element from any surface material to which the antenna 100 is mounted. In addition, the parasitic element 200 distributes any inductance or capacitive reactance effect upon the radiating element, which is described further herein.

Figure 3:
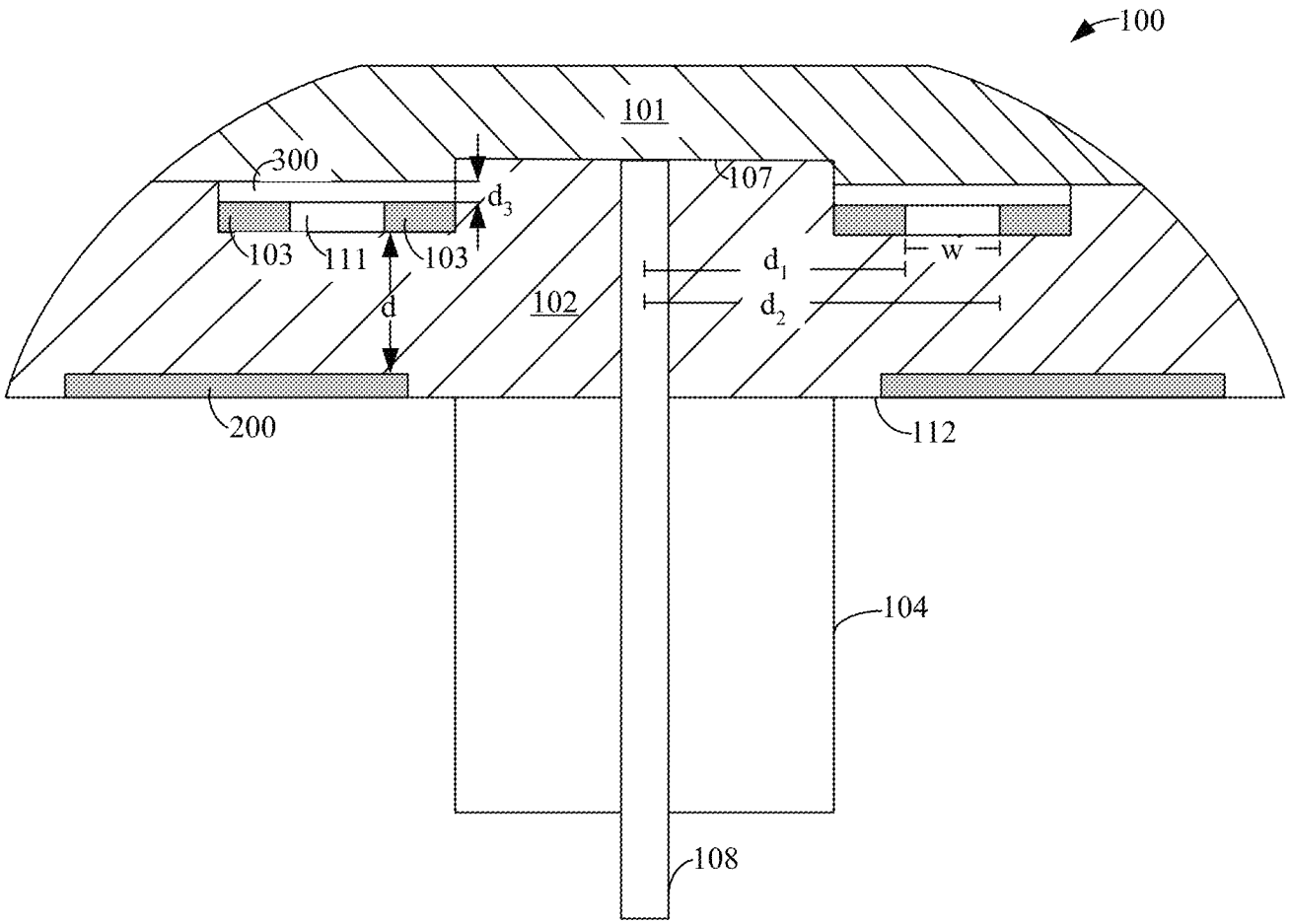
FIG. 3 depicts a cross-sectional view of the antenna of FIG. 1A.

FIG. 3 depicts a cross-sectional view of the antenna 100 depicted in FIG. 1A taken along section A-A of FIG. 1A when the top cover 101 is affixed to the circular housing 102. In this regard, the radiating element 103 is on both sides of the slot 111.

Furthermore the parasitic element 200 is located a distance d from the radiating element 103. In one exemplary embodiment, the distance d is 9.780 mm+/−0.005 mm. The distance d is a value that is determined based upon the resonant frequency of the radiating element 103. In this regard, the radiating element 103 and the parasitic element 200 placed at a distance d from one another creates a capacitive and inductive effect. Notably, stray capacitance exists as a result of the radiating element 103 being placed in proximity with the parasitic element 200 through the insulating material of the housing 102. Such stray capacitance can add to the capacitance inherent in the radiating element 103, which is described further herein. There is inherent in the radiating element 103 and the parasitic element 200 inductance.

Furthermore, as indicated hereinabove, the parasitic element 200 shields the radiating element 103 from any surface to which the underside 112 of the antenna 100 is mounted. Thus, the material of the surface (not shown) to which the antenna 100 is mounted will not affect the performance of the antenna. Notably, the surface will not affect the resonant frequency of the radiating element 103.

Furthermore, the parasitic element 200 and its reactance capacitive and inductive effect upon the radiating element 103 are taken into account when the dimensions of the radiating element 103 are configured. Notably, the larger the radiating element 103, the greater the inductance and capacitance of the radiating element 103. In addition, the smaller the distance d, the greater the capacitive effect on the radiating element 103. Thus, the parasitic element 200 is located within the housing 102 so as to minimize the capacitive effect of the parasitic element 200 on the radiating element 103.

Additionally, when the top cover 101 is placed upon the housing 102 as shown in FIG. 3, a small air space 300 is formed between the radiating element 103 and the top cover 101 and is a depth $d_3$. Notably, the material out of which the top cover 101 is made can affect the resonant frequency characteristics of the radiating element 103. Thus, this air space 300 ensures that the top cover 101 does not affect the electromagnetic waves (not shown) that are emitted from the radiating element 103. In one exemplary embodiment, the depth $d_3$ of the air space 300 is approximately 1.55 mm+/−0.05 mm.

The dimensions of the radiating element 103 are described wherein the radiating element 103 is tuned at 915 Mega Hertz (MHz) or in the range of 902 to 928 MHz. In particular, the slot 111 has a width w of approximately 6.35 millimeters (mm)+/−0.05 mm. The inside of the slot 111 is a distance $d_1$ of approximately 25.725 mm+/−0.005 mm from the center of the protrusion 107, and the outside of the slot 111 is a distance $d_2$ of approximately 32.0675 mm+/−0.0005 from the center of the protrusion 107.

Figure 4:
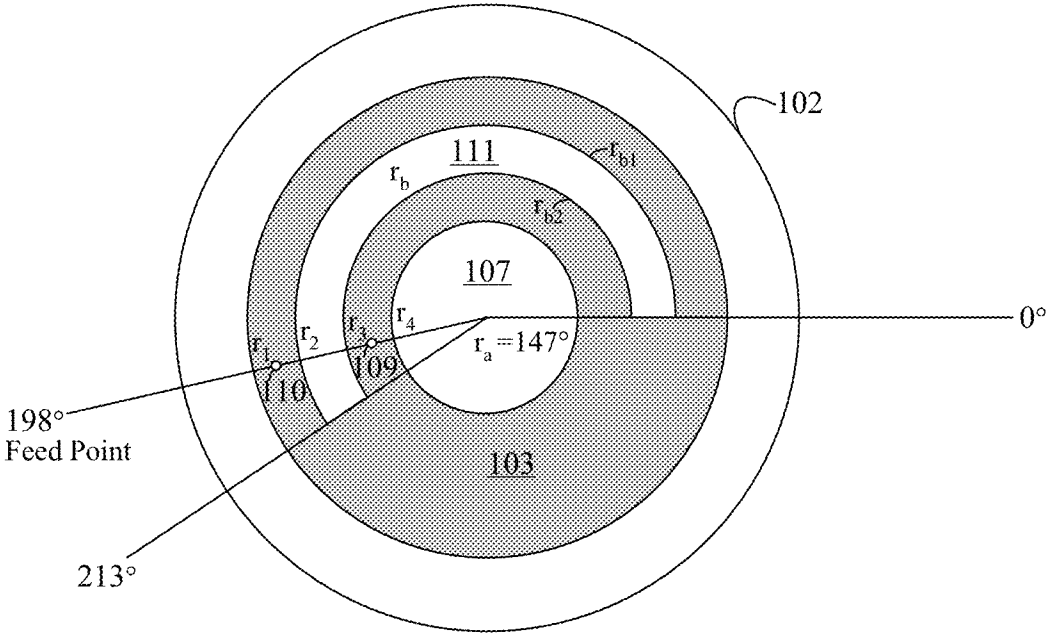
FIG. 4 is a top plan view of a radiating element of FIG. 1A that emits electromagnetic waves at a frequency of approximately 902 to 928 Mega Hertz (MHz).

With reference to FIG. 4, the slot 111 begins at 0° and continues around to 213°. The points 109 and 110 at which the coaxial shield 114 (FIG. 1A) and wire 115 (FIG. 1A) are placed is at approximately 198°.

The designation $r_1$ represents the radius from the center point of the protrusion 107 to the housing 102 and is approximately 38.4175 mm+/−0.0005 mm. The designation r2 represents the radius from the center point of the protrusion 107 to the outside of the slot 111 and is approximately 32.0675 mm+/−0.0005 mm. The designation r3 represents the radius from the center point of the protrusion 107 to the inside of the slot 111 and is approximately 25.7175 mm+/−0.0005 mm, and the designation r4 represents the radius of the protrusion 107 and is approximately 19.3675 mm+/−0.0005 mm. Notably, the shield 114 (FIG. 1A) of the coaxial cable 108 (FIG. 1) is connected between $r_4$ and $r_3$, and the wire 115 (FIG. 1A) of the coaxial cable 108 is connected between $r_1$ and $r_2$ at 198°.

Additionally, $r_{b1}$ is the outside radial arc length of the slot 111, and $r_{b2}$ is the inside radial arc length of the slot 111. The radial arc lengths $r_{b1}$ and $r_{b2}$ are different, i.e., $r_{b1}$ is greater than $r_{b2}$. Because of such difference, the useable bandwidth is increased above a normal slot antenna. This is because the half-wavelength of the inside arc $r_{b2}$ is resonant at a lower frequency and the outside arc $r_{b1}$ is resonant at a higher frequency. Thus, the combination of the lower resonant frequency and the higher resonant frequency increases the bandwidth of the antenna 100. In one embodiment, $r_{b1}$ is 32.07 mm+/−0.05 mm, and $r_{b2}$ is 25.72 mm+/−0.05 mm.

Such configuration of the radiating element 103 radiates electromagnetic waves at a frequency between 902 and 928 MHz. Behavior of the radiating element is described further with reference to FIGS. 5 and 6.

Figure 5:
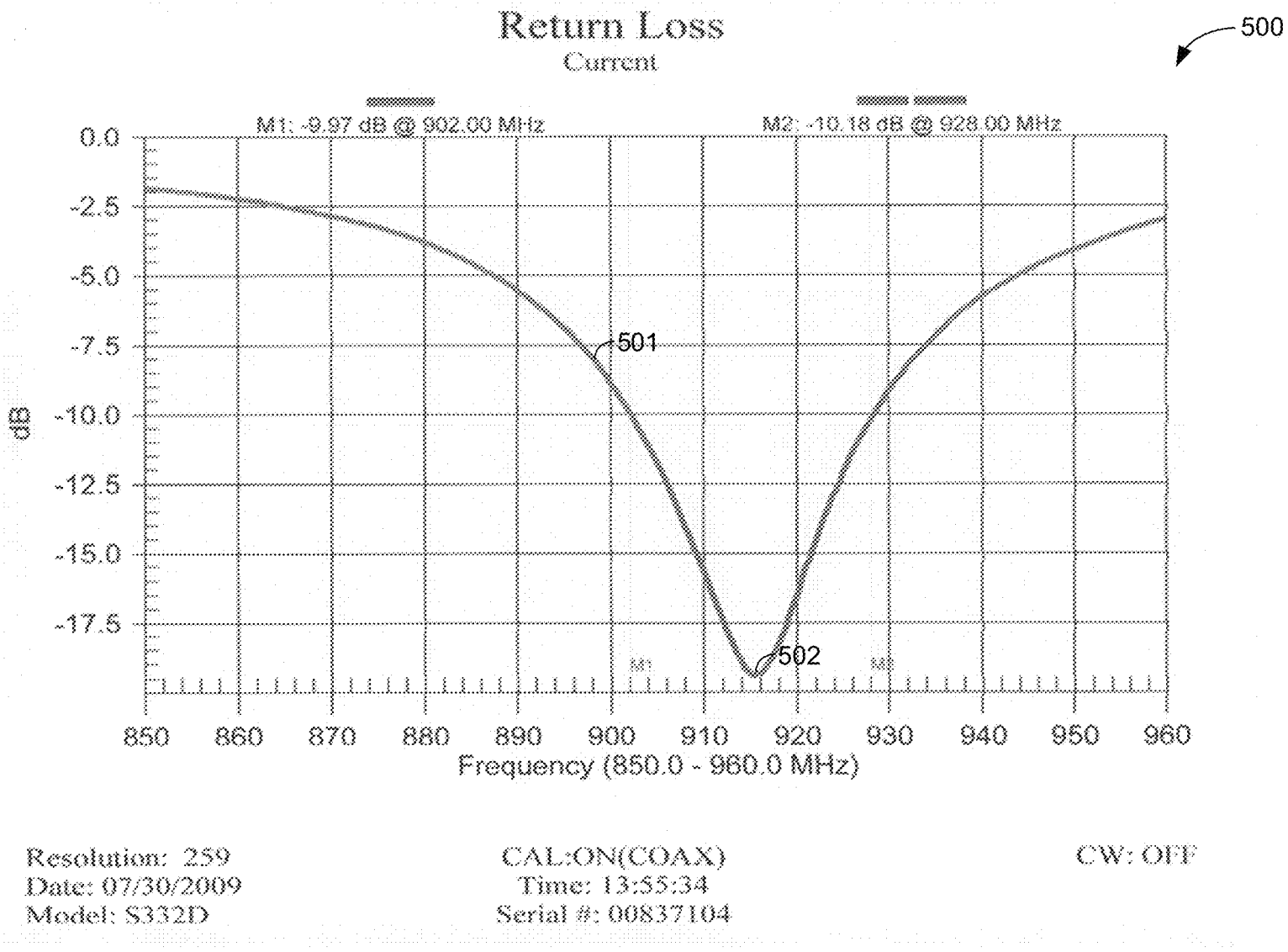
FIG. 5 is a graph depicting the resonant frequency of the radiating element depicted in FIG. 1.

FIG. 5 is a graph 500 having a graph line 501 illustrating the behavior of the radiating element 103 depicted in FIG. 4. Notably, the graph line 501 depicts how well the radiating element accepts energy. In this regard, point 502 on the graph line 501 is the radiating element's resonant frequency, i.e., at point 502 is where the maximum electromagnetic radiation occurs. As the frequency approaches point 502, the radiating element 103 becomes most efficient at point 502.

Figure 6:
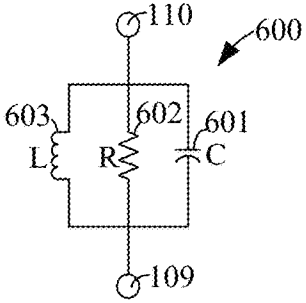
FIG. 6 is a circuit diagram depicting the radiating element of FIG. 1A.

FIG. 6 depicts an RLC circuit 600 representative of the radiating element 103. An RLC circuit is one comprising a resistor 602 having a value of R ohms (Ω), an inductor 603 having a value of L henries (H), and a capacitor 601 having a value of C farads (F). Hence, the term RLC circuit. The RLC circuit 600 is an tuned circuit that produces electromagnetic waves having a resonant frequency determined by the following formula:

$$f = \frac{.159}{2\pi\sqrt{LC}}$$

where L is the value of the inductor, C is the value of the capacitor, and f has the units hertz (or cycles per second).

In order for resonance to occur in the RLC circuit 600 certain values are needed for the inductor 603 and the capacitor 601. In this regard, resonance of the circuit 600 occurs where $$X_L = X_C$$

Where $X_L$ is the reactance of the inductor 603 and $X_C$ is the reactance of the capacitor 601. Furthermore, $X_L$ can be determined by the following formula:

$$X_L = 2\pi fL$$

and $X_C$ can be determined by the following formula:

$$X_C = \tfrac{1}{2}\pi fC.$$

Notably, as the frequency tends to increase, the reactance of the inductor 603 increases. Further, as the frequency increases, the reactance of the capacitor 601 decreases. Thus, the reactance of the inductor 603 and the capacitor 601 are balanced to ensure that the radiating element 103 (FIG. 1A) emits at a particular resonant frequency.

Figure 7:
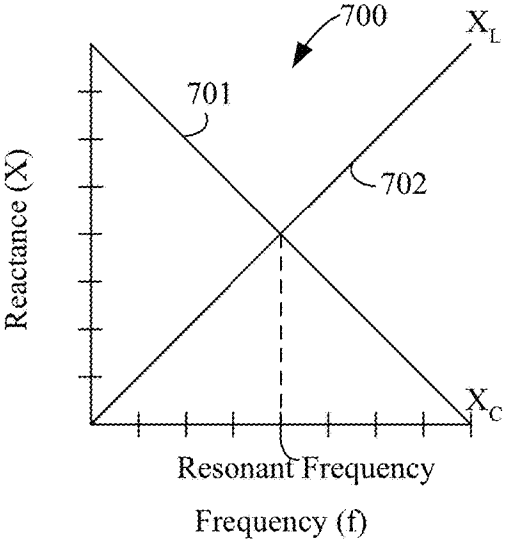
FIG. 7 is a graph depicting the resonant frequency of the circuit of FIG. 6.

FIG. 7 depicts a graph 700 that illustrates the relationship of $X_L$, $X_C$ and f. Notably, the line 702 illustrates that as the frequency increases, the reactance of the inductor 603 (FIG. 6) increases. Furthermore, the line 701 illustrates that as the frequency increases, the reactance of the capacitor 601 (FIG. 6) decreases. The point at which the lines 701 and 702 cross is that point at which the sum of the reactance is equal, i.e., the point at which the RLC circuit 600 (FIG. 6) is at its resonant frequency.

Figure 8:
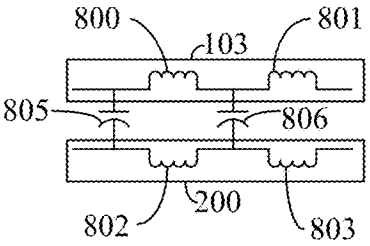
FIG. 8 is a circuit diagram depicting a radiating element and a parasitic element of FIG. 1A.

FIG. 8 is a circuit diagram illustrating the effect of the parasitic element 200 (FIG. 2) on the radiating element 103 (FIG. 1A). The radiating element 103 and the parasitic element 200 have inherent inductance represented by inductors 800, 801 and 802, 803, respectively. Through the insulating material of the housing 102 (FIG. 3), there is stray capacitance represented by capacitors 805, 806. Notably, the further the distance d (FIG. 3) between the radiating element 103 and the parasitic element 200, the less stray capacitance exists. However, the closer the radiating element 103 and the parasitic element 200, the more stray capacitance exists. Thus, when tuning the radiating element 103 to a particular frequency, such stray capacitance created by the radiating element 103 and the parasitic element 200 is taken into account, i.e., it adds to the capacitance of the capacitor 601 (FIG. 6).

Figure 9A:
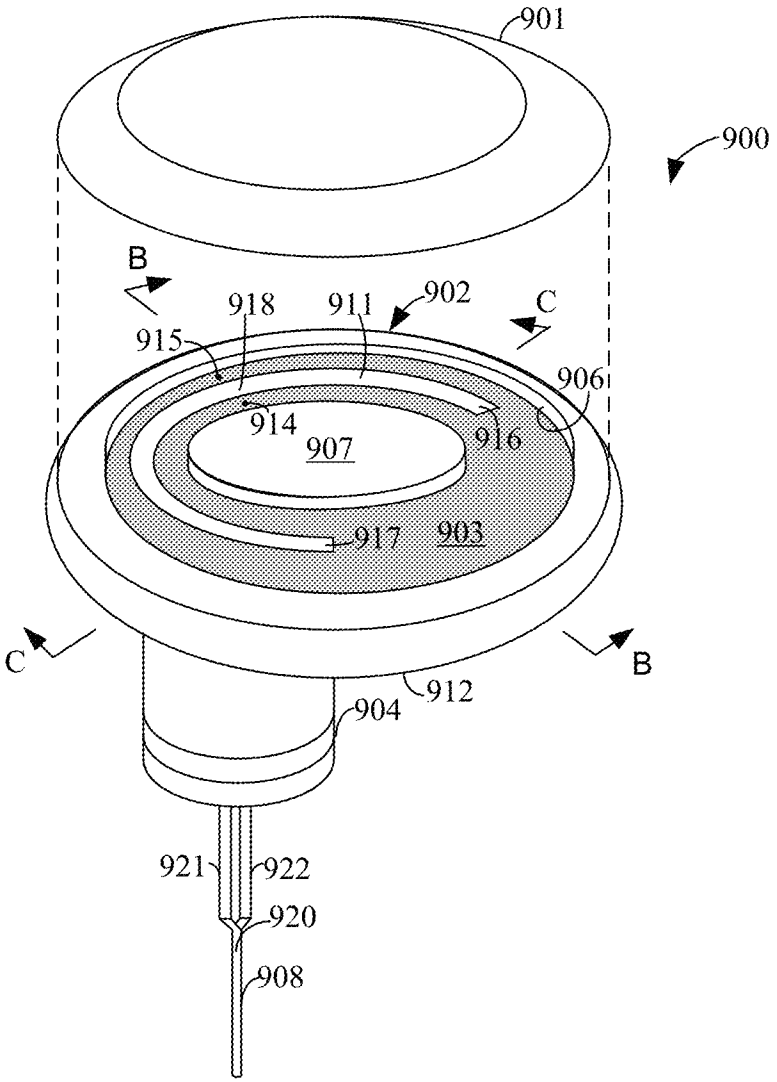
FIG. 9A depicts an exploded view of an antenna in accordance with an embodiment of the present disclosure.

FIG. 9A is an exploded view of an antenna 900 in accordance with an embodiment of the present disclosure. The antenna 900 is substantially the same as the antenna 100 (FIG. 1A) except for the differences described herein. In this regard, the antenna 900 comprises a substantially circular housing 902 and a top cover 901. In one embodiment, the circular housing 902 and the top cover 901 are made of an insulating material, such as, for example polypropylene.

During operation, the top cover 901 is affixed to the substantially circular housing 902. As will be described further herein, the antenna 900 emits electromagnetic waves (not shown) that are both horizontally and vertically polarized. Such electromagnetic waves are emitted through the top cover 901 when it is affixed to the circular housing 902.

The housing 902 comprises a shallow cavity 906 and a substantially circular protrusion 907 that extends from the cavity 906. The circular protrusion 907 is also made of an insulating material, such as, for example polypropylene. Notably, in one embodiment, the shallow cavity 906 is integrally formed with the circular protrusion 907.

Fixed within the cavity 906 is a radiating element 903. The radiating element 903 is substantially circular and is made of a conductive material, such as, for example copper. In one embodiment, the radiating element 903 is made from a stamped piece of metal copper alloy having a thickness of 2 mils.

Furthermore, the radiating element 903 comprises a slot 911 formed within the radiating element 903. The slot 911 is formed as an arc shape. Notably, the slot 911 is formed by the absence of the conductive material that makes up the radiating element 903.

As described hereinabove, the impedance of the slot 911 is distributed along the slot 911 in such a way that at the ends 916 and 917 of the slot 911 the impedance is the lowest, i.e., at the very ends it is zero. As the slot 911 continues from the ends 116 and 117 to the middle 918 of the slot 911, the impedance increases, i.e., the impedance reaches a value of 300 to 500 ohms (Ω).

The antenna 900 further comprises a tube 904. The tube 904 is affixed to the underside of the housing 902. The tube is substantially circular and is hollow. The tube 104 may be made of any type of plastic material known in the art or future-developed. One such difference between the antenna 100 and the antenna 900 is that the tube 904 is affixed at a point off center of the housing 902. As described hereinabove, the tube 104 allows the antenna 900 to be affixed to a structure (not shown), and the tube 104 fits within an opening (not shown) in the structure.

A balun 920 is fed up through the tube 904. The balun 920 consists of a coaxial cable 908 and two traces 921 and 922. The shield (not shown) of the coaxial cable 908 is electrically connected to one of the traces 921, while the wire (not shown) of the coaxial cable 908 is electrically connected to the other trace 922. The balun 920 is a high impedance to low impedance transformer exhibiting impedance from 300 to 500Ω. Thus, the balun 920 is connected to the high impedance point 918 of the slot 911 as described further herein with reference to FIG. 9B.

Figure 9B:
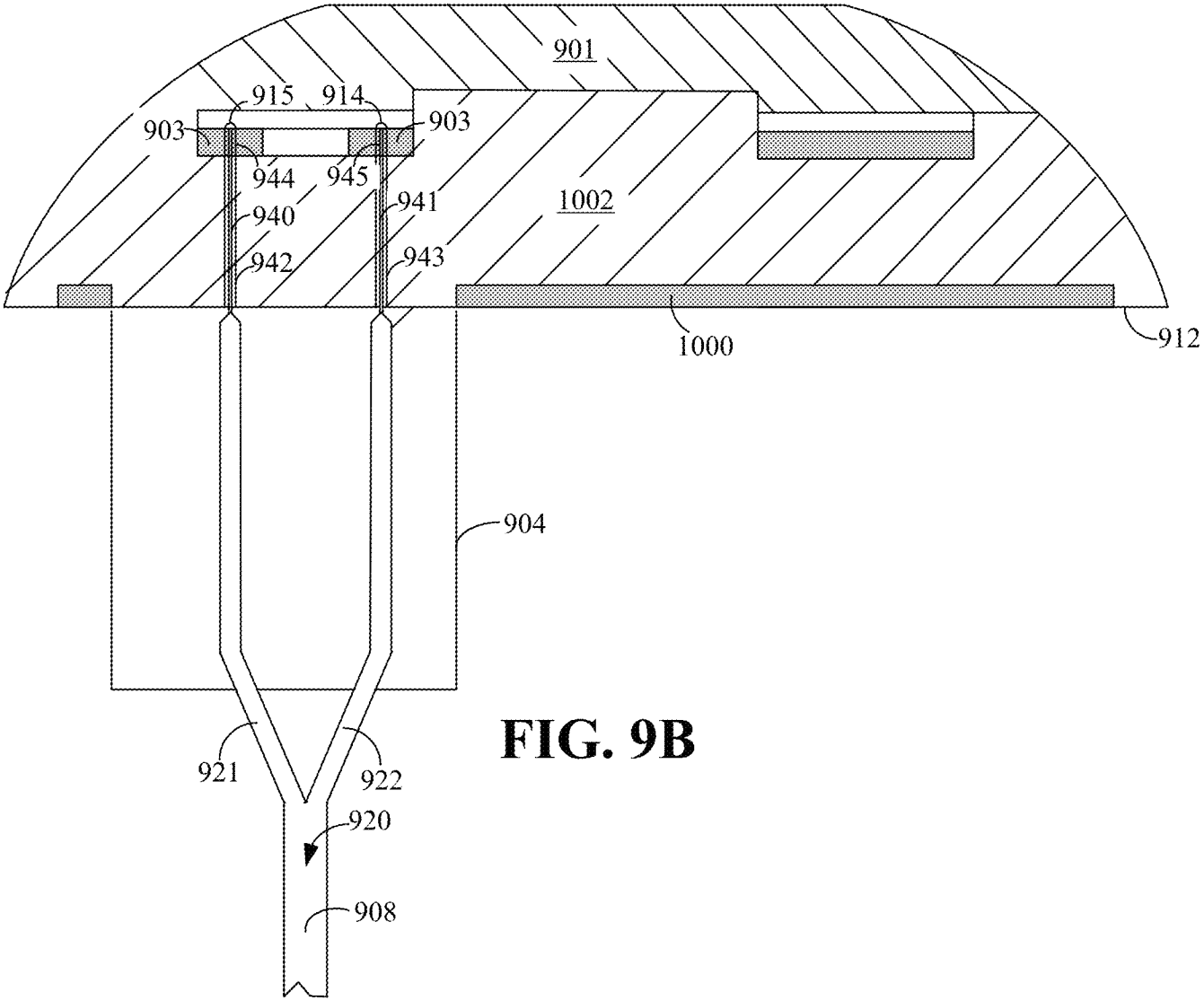
FIG. 9B depicts a cross-sectional view of the antenna of FIG. 9A taken along B-B.

FIG. 9B is a cross sectional view of the antenna 900 taken along B-B of FIG. 9A. With reference to FIG. 9B, each of the traces 921 and 922 terminate with pins 940 and 941, respectively. The pins 940 and 941 are, for example, wires or other conductive material. Each of the traces 921 and 922 are fed through the tube 104, and the pins 940 and 941 are inserted into openings 942 and 943, respectively, in the underside 912 of the housing 902.

Additionally, the pins 940 and 941 are inserted through openings 944 and 945, respectively, in the radiating element 903. The pins 940 and 941 are soldered to the radiating element 103 at points 915 and 914, respectively.

During operation, a radio frequency (RF) signal is supplied from a signal source (not shown) to the coaxial cable 908. The RF signal is applied at points 914 and 915 on the radiating element 103. The RF signal applied produces an alternating current (AC) in the radiating element 903, which produces an electromagnetic wave (not shown) emanating from the slot 911. The electromagnetic waves emanating from the slot 911 are both vertically and horizontally polarized, because the slot 911 is formed into an arc shape that allows for horizontally polarized waves. The electromagnetic waves are radiated uniformly across the hemisphere.

Note that an underside 912 of the housing 902 is substantially flat. This allows the antenna 900 to be mounted to a structure (not shown). For example, the antenna 900 may be mounted to an electric meter (not shown). In this regard, the antenna 900 is a low profile antenna that allows easy installation where a conventional antenna, for example a rod antenna, would be difficult to use.

Figure 10:
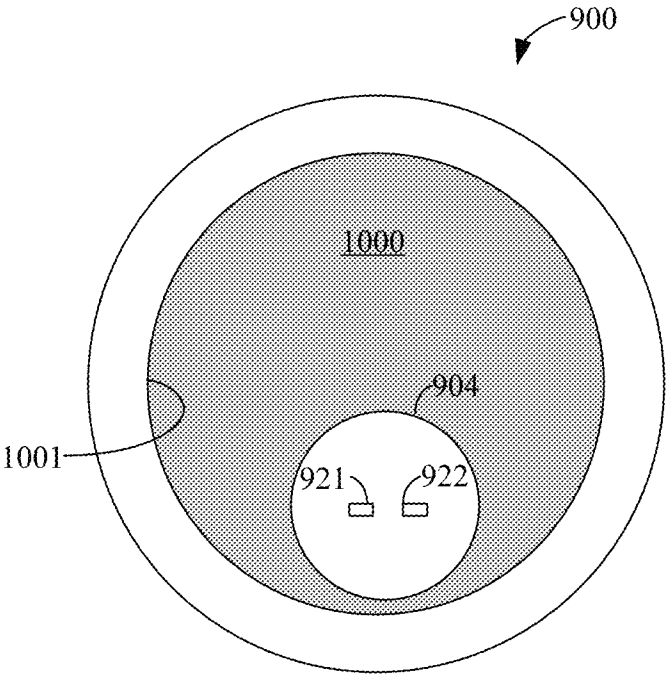
FIG. 10 depicts a bottom view of the antenna of FIG. 9A.

FIG. 10 depicts a bottom view of the housing 902 of FIG. 9A. Formed within the housing 902 is a cavity 1001. Within the cavity 1001 is a substantially circular parasitic element 1000. The parasitic element 1000 can be made of any type of conductive material, such as, for example copper. The parasitic element 1000 does not connect to the coaxial balun 920 or the radiating element 903 (FIG. 9A).

Furthermore, the tube 904 is located in the off center of the parasitic element 1000, and the traces 921 and 922 run up through the tube 904. In one embodiment, the diameter of the parasitic element is 146.05 mm. In addition, the diameter of the tube 904 is 43.561 mm.

As described hereinabove, the parasitic element 1000 isolates the radiating element 903 from any surface material to which the antenna 900 is mounted. In addition, the parasitic element 1000 distributes any inductance or capacitive reactance effect upon the radiating element, which is described further herein.

Figure 11:
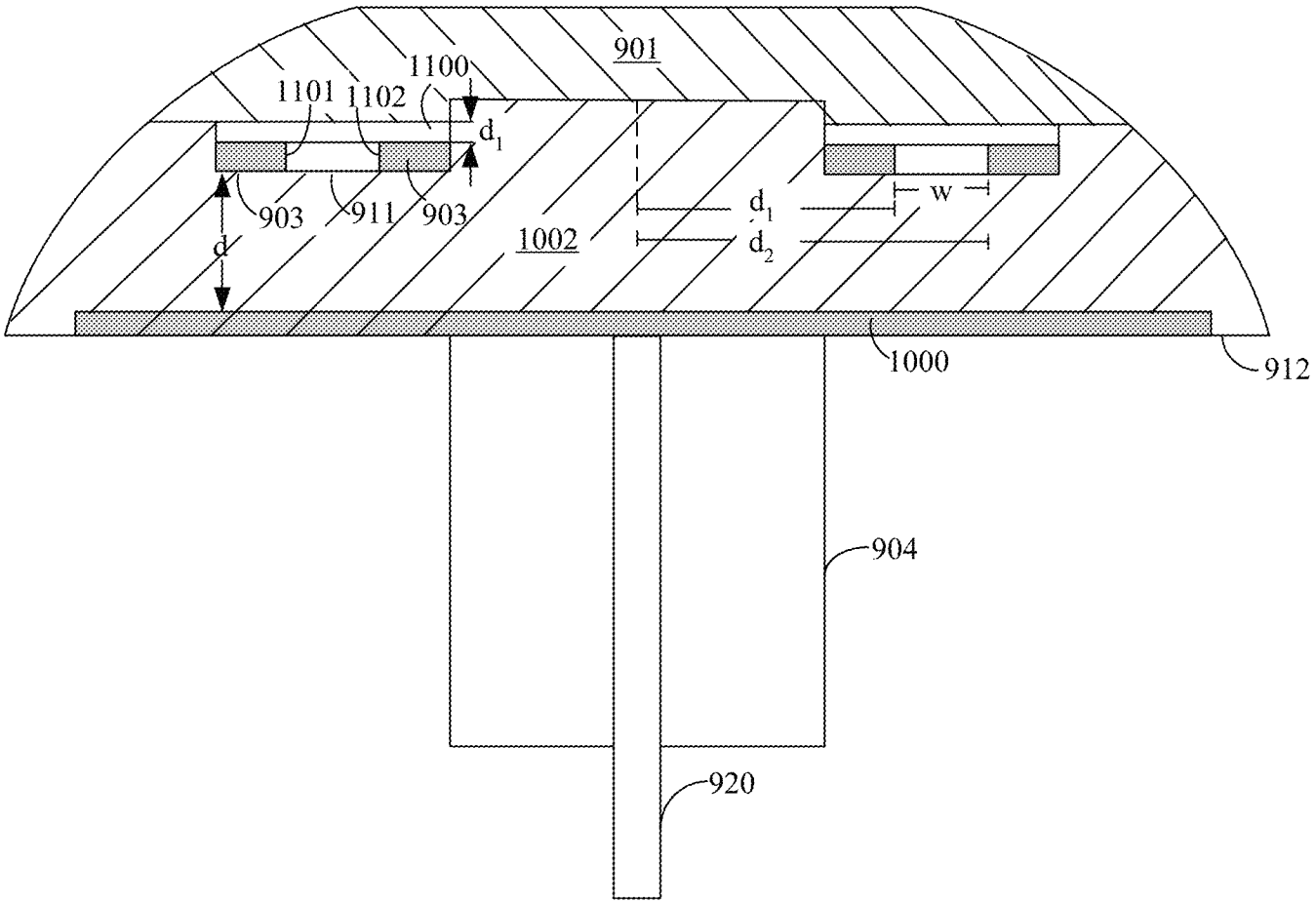
FIG. 11 depicts a cross-sectional view of the antenna of FIG. 9A taken along C-C.

FIG. 11 depicts a cross-sectional view of the antenna 900 depicted in FIG. 9A when the top cover 901 is affixed to the circular housing 902. In this regard, the radiating element 903 is on both sides 1101 and 1102 of the slot 911.

Furthermore the parasitic element 1000 is located a distance d from the radiating element 903. In one exemplary embodiment, the distance d is approximately 4.546 mm+/−0.005 mm. As described hereinabove with reference to FIG. 3, the distance d is a value that is determined based upon the resonant frequency of the radiating element 903. In this regard, the radiating element 903 and the parasitic element 1000 placed at a distance d from one another creates a capacitive effect. Notably, stray capacitance exists as a result of the radiating element 903 being placed in proximity with the parasitic element 1000 through the insulating material of the housing 902. Such stray capacitance can add to the capacitance inherent in the radiating element 903, which is described further herein.

Furthermore, as indicated hereinabove, the parasitic element 1000 shields the radiating element 903 from any surface to which the underside 912 of the antenna 900 is mounted. Thus, the material of the surface (not shown) to which the antenna 900 is mounted will not affect the performance of the antenna. Notably, the surface will not affect the resonant frequency of the radiating element 903.

Furthermore, the parasitic element 1000 and its reactance or capacitive and inductive effect upon the radiating element 903 is taken into account when the dimensions of the radiating element 903 are configured. Notably, the larger the radiating element 903, the greater the inductance and capacitance of the radiating element 903. In addition, the less the distance d, the greater the capacitive effect on the radiating element 903. Thus, the parasitic element 1000 is disposed within the housing 902 so as to minimize the capacitive effect of the parasitic element 1000 on the radiating element 903.

In addition, FIG. 11 shows the tube 904. As shown the tube 904 is off center on the underside 912 of the housing 102. This allows the balun 920 to be inserted therein and the traces 921 (FIG. 9A) and 922 (FIG. 9A) to be connected to the points 914 and 915 at the high impedance point 918 (FIG. 9A).

Additionally, when the top cover 901 is placed upon the housing 902 as shown in FIG. 11, a small air space 1100 is formed between the radiating element 903 and the top cover 901 and the air space 300 has a depth $d_3$. Notably, the material out of which the top cover 901 is made can affect the resonant frequency characteristics of the radiating element 103. Thus, this air space 300 ensures that the top cover 101 does not affect the electromagnetic waves (not shown) that are emitted from the radiating element 103 by not affecting the characteristics of the radiating element 103. In one exemplary embodiment, the depth $d_3$ of the air space 300 is approximately 1.55 mm+/−0.05 mm.

The dimensions of the radiating element 903 are described wherein the radiating element 903 is tuned at 460 Mega Hertz (MHz) or in the range of 450 to 470 MHz. In particular, the slot 911 has a width w of 6.35 mm+/−0.05 mm. The inside of the slot 911 is a distance $d_1$ of 43.545 mm+/−0.005 mm from the center of the protrusion 107, and the outside of the slot 911 is a distance $d_2$ of 48.985 mm+/−0.005 mm from the center of the protrusion 107.

Figure 12:
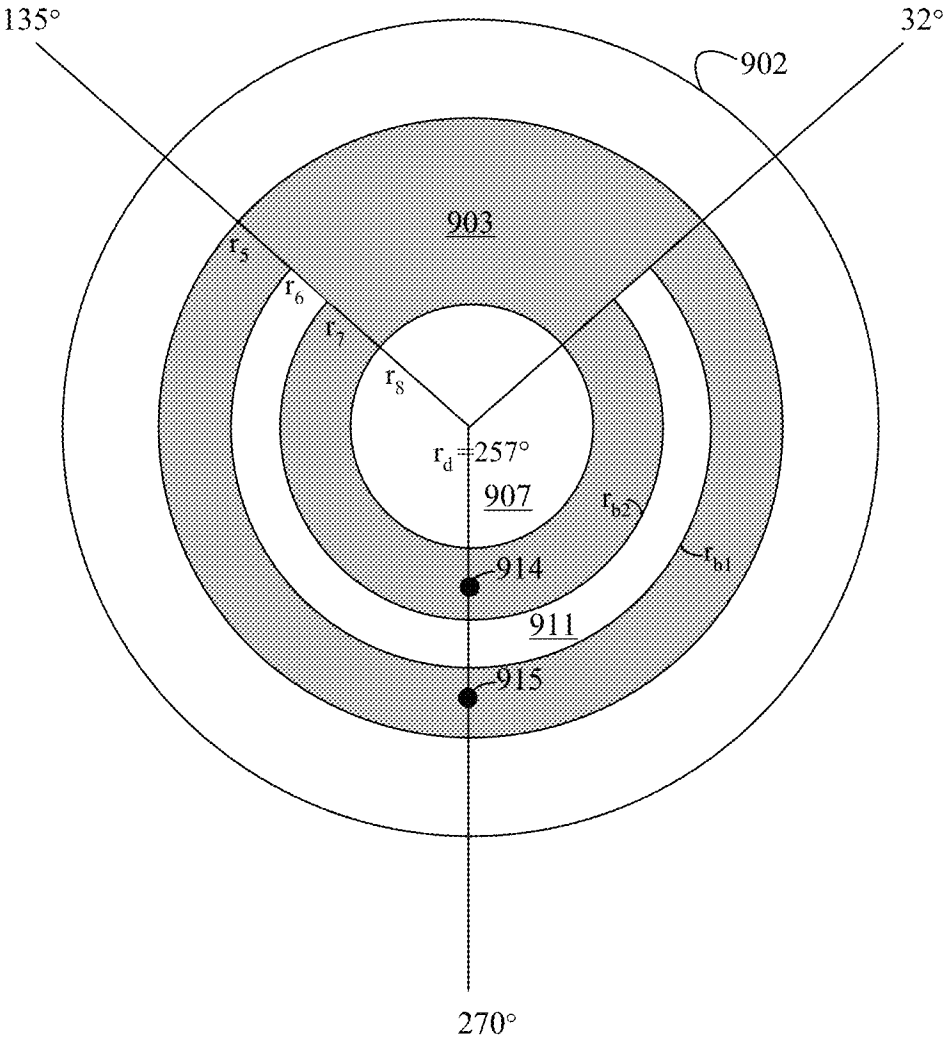
FIG. 12 is a top plan view of a radiating element of FIG. 9A that emits electromagnetic wave at a frequency of approximately 450 to 470 Mega Hertz (MHz).

With reference to FIG. 12, the slot 911 begins at 32° and continues around to 135°. Thus, the slot 911 extends approximately the angle $r_d$ for 257°. The traces 921 (FIG. 9A) and 922 (FIG. 9A) are electrically connected to points 914 and 915 on the radiating element 103 at the high impedance point 918 (FIG. 9A) of the slot 911, i.e., the high impedance point is at 270°.

The designation $r_5$ represents the radius from the center point of the protrusion 907 to the housing 902 and is approximately 55.245 mm+/−0.005 mm. The designation r6 represents the radius from the center point of the protrusion 907 to the outside of the slot 911 and is approximately 48.895 mm+/−0.005 mm. The designation $r_7$ represents the radius from the center point of the protrusion 907 to the inside of the slot 911 and is approximately 43.545 mm+/−0.005 mm, and the designation $r_8$ represents the radius of the protrusion 907 and is approximately 41.91 mm+/−0.05 mm. Notably, the trace 921 is connected between $r_7$ and $r_8$ at point 914, and the trace 922 is connected between $r_5$ and $r_6$ at point 915 at approximately 270°.

Additionally, $r_{b1}$ is the outside radial arc length of the slot 911, and $r_{b2}$ is the inside radial arc length of the slot 911. The radial arc lengths $r_{b1}$ and $r_{b2}$ are different, i.e., $r_{b1}$ is greater than $r_{b2}$. Because of such difference, the useable bandwidth is increased above a normal slot antenna. This is because the half-wavelength of the inside arc $r_{b2}$ is resonant at a lower frequency and the outside arc $r_{b1}$ is resonant at a higher frequency. Thus, the combination of the lower resonant frequency and the higher resonant frequency increases the bandwidth of the antenna 100. In one embodiment, $r_{b1}$ is 48.90 mm+/−0.05 mm, and $r_{b2}$ is 48.26 mm+/−0.05 mm.

Such configuration of the radiating element 103 radiates electromagnetic waves at a frequency between 450 and 470 MHz.

Notably, the present disclosure describes antenna technology that is scalable to other frequency ranges. The present disclosure provides two examples of the antenna technology in FIGS. 1A and 1B (902 MHz to 948 MHz) and FIGS. 9A and 9B (450 MHz to 470 MHz), which are working examples.

The invention claimed is:

1. An antenna, comprising:

a radiating element having an arc-shaped slot, the arc-shaped slot extending greater than 180 degrees and less than 360 degrees on the radiating element, the radiating element further comprising a central opening, the central opening disposed inwardly from the arc-shaped slot;

a parasitic element in proximity with but spaced apart from the radiating element, the parasitic element not directly connected to the radiating element, the spacing apart of the parasitic element from the radiating element creating a capacitive and inductive effect;

an insulating material disposed between the radiating element and the parasitic element;

a housing having a top shallow cavity in a top of the housing and a bottom shallow cavity in a bottom of the housing, where the radiating element is disposed in the top shallow cavity and the parasitic element is disposed in a bottom shallow cavity, the housing formed from the insulating material.

2. The antenna of claim 1, further comprising a substantially circular protrusion that extends from the top of the housing, the protrusion extending through the central opening of the radiating element, the protrusion having an opening.

3. The antenna of claim 2, the protrusion comprising an insulating material.

4. The antenna of claim 3, wherein a balun having a first and second trace extends through the parasitic element and through the opening in the center of the protrusion.

5. The antenna of claim 4, wherein the first trace is electrically connected to the radiating element on a first side of the slot.

6. The antenna of claim 5, wherein the second trace is electrically connected to the radiating element on a second side of the slot.

7. The antenna of claim 6, wherein the balun is high impedance connected to the radiating element.

8. The antenna of claim 7, wherein the balun is connected to the radiating element at a point that is substantially 135 degrees from an end of the slot.

9. An antenna, comprising:

a substantially circular radiating element, the radiating element having an arc-shaped slot formed therein, the arc-shaped slot extending greater than 180 degrees and less than 360 degrees on the radiating element;

a substantially circular parasitic element in proximity with, but separated from, the substantially circular radiating element by an insulating material, the parasitic element not directly connected to the radiating element; and a cable electrically connected to the radiating element, the cable not directly connected to the parasitic element, wherein the cable is a coaxial cable and is connected to the radiating element across the slot such that a shield of the coaxial cable is electrically connected to a first side of the slot and a wire of the coaxial cable is electrically connected to a second side of the slot; and wherein the cable is a balun formed by electrically connecting a shield of a coaxial cable to a first trace and a wire of the coaxial cable to a second trace.

10. Then antenna of claim 9, wherein the first trace is electrically connected to a first side of the slot and the second trace is connected to a second side of the slot.

* * * * *